US006201938B1

(12) United States Patent
Hollar et al.

(10) Patent No.: US 6,201,938 B1
(45) Date of Patent: Mar. 13, 2001

(54) ROLL FUSING APPARATUS INCLUDING A FUSING NIP FORCE CONTROLLING ASSEMBLY

(75) Inventors: Thomas C. Hollar, Penfield; Jaime Soley, Rochester; Karl (khaled) B. Ayash, Webster, all of NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/499,655

(22) Filed: Feb. 8, 2000

Related U.S. Application Data

(60) Provisional application No. 60/138,589, filed on Jun. 11, 1999.

(51) Int. Cl.[7] ..... G03G 15/20; H05B 1/00

(52) U.S. Cl. ..... 399/67; 399/328; 219/216

(58) Field of Search ..... 73/35.09, 35.11, 73/35.12; 399/67, 328, 329, 330, 331, 333; 219/216

(56) References Cited

U.S. PATENT DOCUMENTS

| | | | |
|---|---|---|---|
| 3,906,800 | 9/1975 | Thettu | 73/432 R |
| 3,926,058 | 12/1975 | Thettu | 73/432 R |
| 4,232,959 * | 11/1980 | Ateya et al. | 399/328 |
| 4,397,097 | 8/1983 | Damrau et al. | 33/182 |
| 4,744,253 | 5/1988 | Hermkens | 73/862.55 |

* cited by examiner

*Primary Examiner*—Arthur T. Grimley
*Assistant Examiner*—Hoang Ngo
(74) *Attorney, Agent, or Firm*—Tallam I. Nguti

(57) ABSTRACT

A roll fusing apparatus for effectively heating and fusing quality toner images on various different types of substrates is provided. The roll fusing apparatus includes a frame; a heated fuser roller having a first end and a second end respectively mounted to the frame; and a pressure roller mounted to the frame and forming a fusing nip with the heated fuser roller. The heated fuser roller and the pressure roller are movable for receiving, heating and applying a nip force to toner images being moved through the fusing nip on various different types of substrates. The roll fusing apparatus importantly includes a fusing nip force controlling assembly for precisely setting and controlling fusing nip forces within the fusing nip at different values for effectively heating and fusing quality toner images on the various different types of substrates. The fusing nip force controlling assembly includes a piezoelectric member connected to at least one of the heated fuser roller and the pressure roller for producing an electrical signal responsively and proportionally to a nip force being applied within the fusing nip between the heated fuser roller and the pressure roller.

9 Claims, 3 Drawing Sheets

ROLL FUSING APPARATUS INCLUDING A FUSING NIP FORCE CONTROLLING ASSEMBLY

This Application is based on a Provisional Application No. 60/138,589, filed on Jun. 11, 1999.

BACKGROUND OF THE INVENTION

This invention relates to nip force controlling devices, and more particularly to a roll fusing apparatus in electrostatographic reproduction machines including a life-extending fusing nip force controlling device.

In industry, substrate handling machines in which paper, film, or other thin substrate material are conveyed, typically use a combination of at least a pair of rolls or rollers that are pressed against each other to form a nip by which, and through which the thin substrate material is conveyed.

In electrostatographic reproduction machines which produce toner copies of images, a pair of fusing rollers, (one of which is heated and the other a pressure roller) are used to form a fusing or fusing nip. Loose powder toner images formed on a copy substrate, such as a copy sheet of paper, are fed through the fusing nip in order to heat, fuse and permanently fix the toner image to the copy substrate. The fusing nip force is very important. If the nip forces are high and thus the overall pressure (force over area) is too light, there will not be enough heat transfer to adequately bond the toner to the paper, this will cause the print to deteriorate. Also, if there is an uneven pressure distribution along the roll, the paper will not track straight as it passes through the rolls. For best fusing results, it is desirable to have close control over the temperature and pressure applied to, as well as the dwell time within the nip of, each unit area of toner powder images being fused and fixed. To achieve such control, the nip force of the fusing nip must be set accurately during machine manufacture, as well as later on, on a regular basis, in the field due to wear, and to the effect of machine jams.

In general, as two nip-forming cylindrical rolls or rollers are pressed against each other to form a nip, there exists a two-dimensional plane or area of contact between the rollers. In electrostatographic reproduction machines, the geometry of this contact area directly impacts the quality of the fused toner images reproduced. In particular, as each copy sheet travels through the fusing nip, its path of travel may vary if the contact geometry is not symmetric along the center of the rollers. A non-symmetric contact geometric area ordinarily results in either sheet skew, or copy damage. In addition, if the nip geometry is out of tolerance, the powder toner may not be fused properly onto the copy sheet.

Conventionally, fusing nip forces, gaps and pressures in electrostatographic reproduction machines are set in the factory or in the field by trained operators using static measuring devices or tools. For example, fusing nip widths or footprints may be measured using a powder-on-roll indicator, or some visual scale for gauging the nip width. Adjustments require that adjustment screws be turned in a trial and error manner during manufacturing or in the field turn in attempts to obtain acceptable nip width, force or pressure. Accordingly, such trial and error methods usually require several iterations of the measure and adjust cycles, and typically depend on subjective operator feel and judgment.

Because the fusing nip force can significantly impact copy quality, there exists a need for a device or assembly to control it. Some known devices for making measurements within roll nips, in order to achieve and maintain close control, are disclosed for example in the following references. U.S. Pat. No. 3,760,637 issued Sep. 25, 1973, to Budinger et al., for example, discloses a tool for measuring the pressure exerted at the nip between two rolls. The tool includes a thin-walled, non-rigid tube, a fluid conduit, means for pressurizing fluid passed through the conduit, and means for measuring the fluid pressure when it is balanced by the nip pressure.

U.S. Pat. No. 3,906,800 issued Sep. 23, 1975, to Thettu, discloses a reusable nip measuring device and method. The device consists of two polyimide sheets each having a thickness of 3 to 8 microns, and one of which is coated with silicone rubber material. When placed in the heat and pressure nip of a fuser for a determined period, the silicone rubber sheet forms an impression on the uncoated sheet corresponding to the contact arc of the nip.

U.S. Pat. No. 3,926,058 issued Dec. 16, 1975, to Thettu, discloses a device for measuring the contact arc and pressure characteristics of a roll fuser nip. The device consists of silicone rubber layer into which a toner powder pattern is formed and fused, and of a sheet of paper placed of the toner powder pattern. When the device as arranged is placed in the heat and pressure nip of a fuser for a determined period, a portion of the powder pattern corresponding to the contact arc is offset onto the sheet of paper.

U.S. Pat. No. 4,397,097 issued Aug. 9, 1983, to Damrau et al. discloses a gauge for measuring the size of a roll nip. The gauge includes a cylindrical carrier enclosing a pivotal platform. It also includes a U-shaped rod or probe and a transducer mounted on the platform. In use, the medial portion of the U-shaped probe is moved into the nip until the carrier contacts the rolls, so that the transducer can give a readout in accordance with the radii of the rolls at the point of contact by the probe.

U.S. Pat. No. 4,744,253 issued May 17, 1988, to Hermkens discloses a system for determining the pressure in the nip between two rollers. The system includes a pressure sensor and a device for transmitting an ultrasonic wave in the sensor, and receiving a reflected pulse thereof. According to the system, a time difference between a transmission pulse and its reflected pulse is related to the pressure exerted on an object in the nip.

Xerox Disclosure Journal, Vol. 15, No. 4, July/August 1990 discloses a fuser nip length sensor consisting of a thin profile linear potentiometer. The potentiometer includes a voltage divider consisting of a strip of resistive material, a series of taps therealong, force sensitive switches and a common terminal. When placed longitudinally within the nip, only a portion of the potentiometer corresponding to the length of the nip will be compressed.

Xerox Disclosure Journal, Vol. 15, No. 6 November/December 1990 discloses a tool for measuring fuser nip pressure. The tool includes short force sensing resistors placed over metallic conductors constructed in an interdigitated pattern and mounted between two polymer sheets forming a network. Two metallic strips running the entire length of the tool connect the network to a measurement device. When the tool is inserted in a nip, pulses from the force sensing resistors are timed, and the time data is used along with fuser speed to calculated nip force.

Xerox Disclosure Journal, Vol. 18, No. 4 July/August 1993 discloses a fuser nip sensor for determining nip pressure and nip length. The tool also includes short force sensing resistors in addition to two sensor heads placed in proximity to the nip for determining nip length.

SUMMARY OF THE INVENTION

A roll fusing apparatus for effectively heating and fusing quality toner images on various different types of substrates is provided. The roll fusing apparatus includes a frame; a heated fuser roller having a first end and a second respectively mounted to the frame; and a pressure roller mounted to the frame and forming a fusing nip with the heated fuser roller. The heated fuser roller and the pressure roller are movable for receiving, heating and applying a nip force to toner images being moved through the fusing nip on various different types of substrates. The roll fusing apparatus importantly includes a fusing nip force controlling assembly for precisely setting and controlling fusing nip forces within the fusing nip at different values for effectively heating and fusing quality toner images on the various different types of substrates. The fusing nip force controlling assembly includes a piezoelectric member connected to at least one of the heated fuser roller and the pressure roller for producing an electrical signal responsively and proportionally to a nip force being applied within the fusing nip between the heated fuser roller and the pressure roller.

BRIEF DESCRIPTION OF THE DRAWINGS

Other features of the present invention will become apparent as the following description proceeds and upon reference to the drawings, in which.

DETAILED DESCRIPTION OF THE INVENTION

While the present invention will be described below in connection with respect to a fusing nip in the exemplary electrostatographic machine and as a particular preferred embodiment thereof, it will be understood that it is not intended to limit the invention to just that use or just that embodiment. On the contrary, it is intended to cover all alternatives, modifications, and equivalents as may be included within the spirit and scope of the invention as defined by the appended claims.

Figure 1:
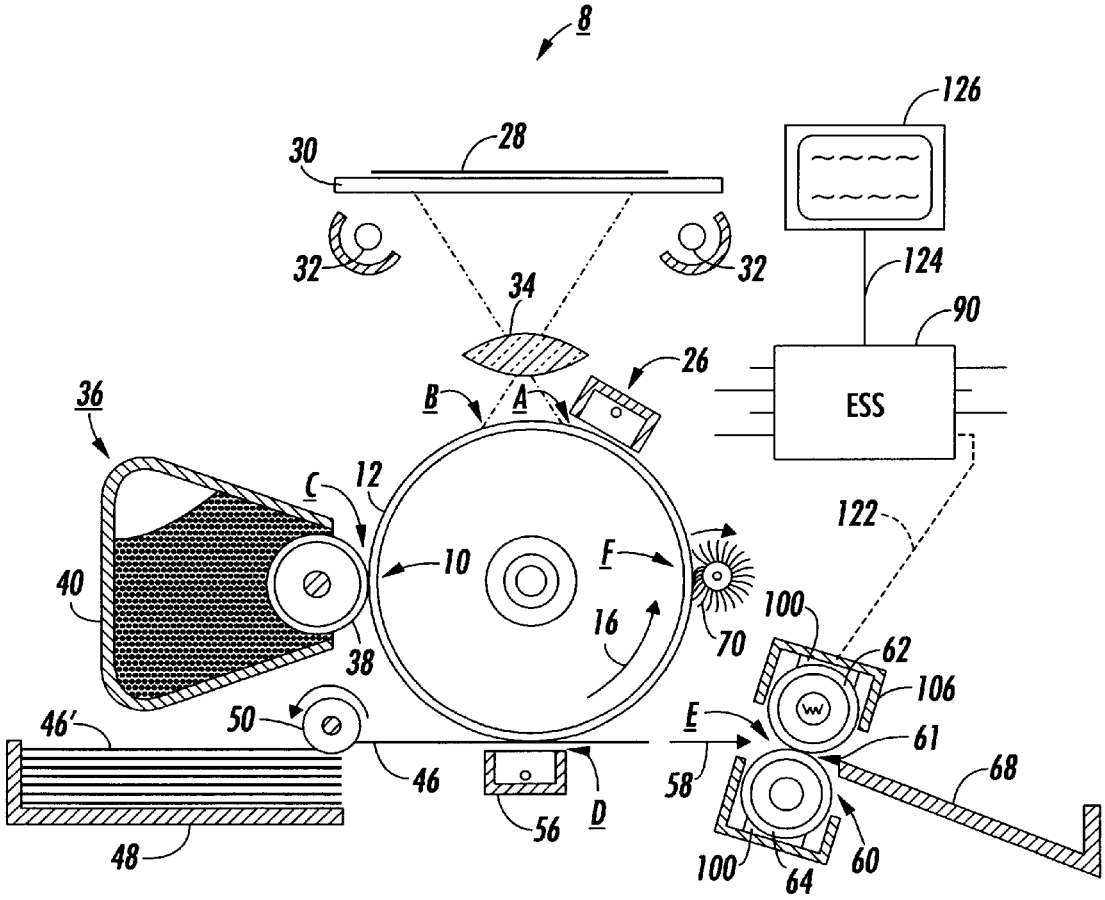
FIG. 1 is a schematic of an exemplary electrostatographic reproduction machine having a fusing apparatus including the life-extending fusing nip force c trolling assembly of the present invention.

Referring initially to FIG. 1, an exemplary electrostatographic reproduction machine 8 in which the present invention can be effectively used, is illustrated. The exemplary electrophotographic machine 8, for example, employs a photoreceptive member shown as a drum 10 including a photoconductive surface 12. As is well known, the photoconductive member can equally be a suitably mounted belt having a photoconductive surface. The photoconductive drum 10 is coupled to motor (not shown) for rotation about a process path in the direction of arrow 16 for advancing successive portions of photoconductive surface 12 through various processing stations disposed about the process path.

Initially, a surface portion of drum 10 passes through a charging station A. At charging station A, a corona generating device 26 charges photoconductive surface 12 to a relatively high and substantially uniform potential. Once charged, photoconductive surface 12 is advanced to an imaging station B where an original document 28, positioned face down and in accordance with a fixed registration mark or position-on a transparent platen 30, is exposed to light from light sources, such as lamps 32. Light rays from the lamps 32 are reflected image-wise from the document 28 thus forming a light image of the original document 28. The reflected rays are transmitted through a lens 34 and focused onto a portion of the charged photoconductive surface 12, selectively dissipating the uniform charge on impacted areas thereof. As such, an electrostatic latent image corresponding to the original document 28 is recorded onto photoconductive surface 12.

Although an optical system has been shown and described for forming the light image used to selectively discharge the charged photoconductive surface 12, one skilled in the art will appreciate that a properly modulated scanning beam of energy (e.g., a laser beam) may equally be used to image-wise irradiate the charged portion of the photoconductive surface 12 in order to record the latent image thereon.

After the electrostatic latent image is recorded on photoconductive surface 12, drum 10 advances to development station C where a development apparatus 36, deposits developing material containing charged toner particles onto the electrostatic latent image. Development apparatus 36 for example may include a single developer roller 38 disposed in a developer housing 40. The developer roller 38 rotates, bringing the developing material into contact with photoconductive surface 12, thus developing the latent image into a visible toner image.

After development of the electrostatic latent image as such, drum 10 advances the toner image to transfer station D. At transfer station D, a sheet of support material 46 is moved into contact with the toner image by means of a sheet feeding apparatus 48. Preferably, sheet feeding apparatus 48 includes a feed roller 50 which rotates while in contact with a stack of sheets 46 to advance the uppermost sheet. The advancing sheet of support material 46 is moved into contact with photoconductive surface 12 of drum 10 at transfer station D in a timed sequence so that the developed image on the surface 12 contacts the advancing sheet of support material 46, and is transferred. A transfer corotron 56 is provided for projecting ions onto the backside of sheet 46 in order to aid in inducing the transfer of charged toner images from the photoconductive surface 12 onto support material 46.

The support material 46 is subsequently transported in the direction of arrow 58 for advancement to a fusing station E. Fusing station E is suitable for using the life-extending fusing nip force controlling device of the present invention, and includes a fuser assembly 60 for heating and permanently affixing the transferred toner image to sheet 46. Fuser assembly 60 preferably includes a heated fuser roller 62 and a support roller 64 forming a fusing nip 102 for receiving and transporting a sheet of support material 46 therethrough. Within the fusing nip 102 as discussed above, the temperature is maintained about 400° F., so that loose powder toner forming images on the copy sheet of support material or substrate 46 are heated, fused and permanently fixed by contact pressure between the two rolls to the sheet. The actual contact arc or area of the nip 102 as determined by the width of the roll nip is therefore very important. If the overall pressure is too light because of poor, little or non-continuous contact, there will be insufficient heat transfer to the toner, as well as insufficient pressure to adequately fuse and bond the toner to the sheet. This, of course, will cause the resulting fused image or print to be of poor quality.

In addition, if there is an uneven pressure distribution along the length of the nip from one end to the other of the rolls, the sheet will likely not track straight as it passes through the nip. For best fusing results, it is desirable, therefore, to have close and precise control over the temperature and pressure applied to, as well as the dwell time of the toner image within the fusing nip. The tool of the present invention (to be described in detail below) is particularly useful for achieving such close and precise control. The tool is particularly useful for setting nip width of the fuser roll nip accurately during machine 8 manufacture, as well as on a regular basis in the field to correct changes in initial settings due to machine 8 wear and tear, and to the effects of machine 8 jams.

Still referring to FIG. 1, after the toner image on the sheet 46 is fused as above, the sheet 46 of support material is moved to a receiving tray 68 for subsequent removal by an operator. Invariably, after the support material 46 was separated from the photoconductive surface 12 of drum 10, some residual developing material remained adhered to drum 10. Thus, a final processing station, namely cleaning station F, is provided for removing residual toner particles from photoconductive surface 12 in preparation for subsequent charging and imaging as described above. Cleaning station F, for example, can include a rotatably mounted fibrous brush 70 for physical engagement with photoconductive surface 12 in order to remove toner particles therefrom.

The foregoing description is believed to be sufficient, for purposes of the present application for patent, to illustrate the general operation of an electrostatographic reproduction or printer machine 8 including the self-aligning corona generating or charging device of the present invention.

Conventionally, fusing nip forces, gaps and pressures in electrostatographic reproduction machine 8*s* are set in the factory or in the field by trained operators using static measuring devices or tools. For example, fusing nip widths or footprints may be measured using a powder-on-roll indicator, or some visual scale for gauging the nip width. Adjustments require that adjustment screws be turned in a trial and error manner during manufacturing or in the field turn in attempts to obtain acceptable nip width, force or pressure. Accordingly, such trial and error methods usually require several iterations of the measure and adjust cycles, and typically depend on subjective operator feel and judgment.

In accordance with the present invention, there is provided a roll fusing apparatus 60 including a fusing nip force controlling assembly 100 for precisely sensing and displaying fusing nip force and pressure, and for automatically or manually adjusting the fusing nip force loading responsively to a sensed fusing nip force and pressure.

Figure 2:
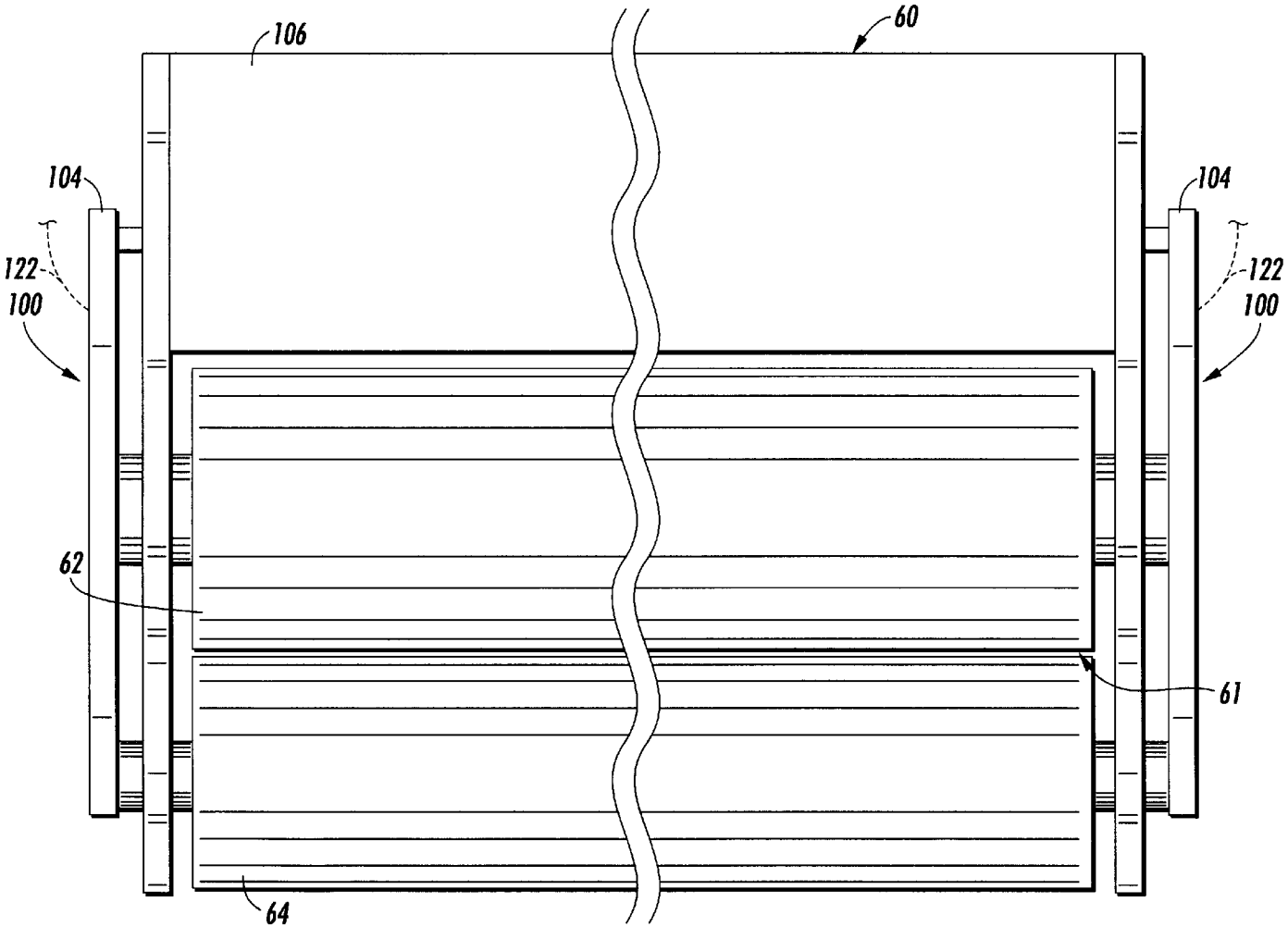
FIG. 2 is a schematic top view of the fusing apparatus of FIG. 1 including at each thereof a life-extending fusing nip force controlling assembly in accordance with the present invention.
Figure 3:
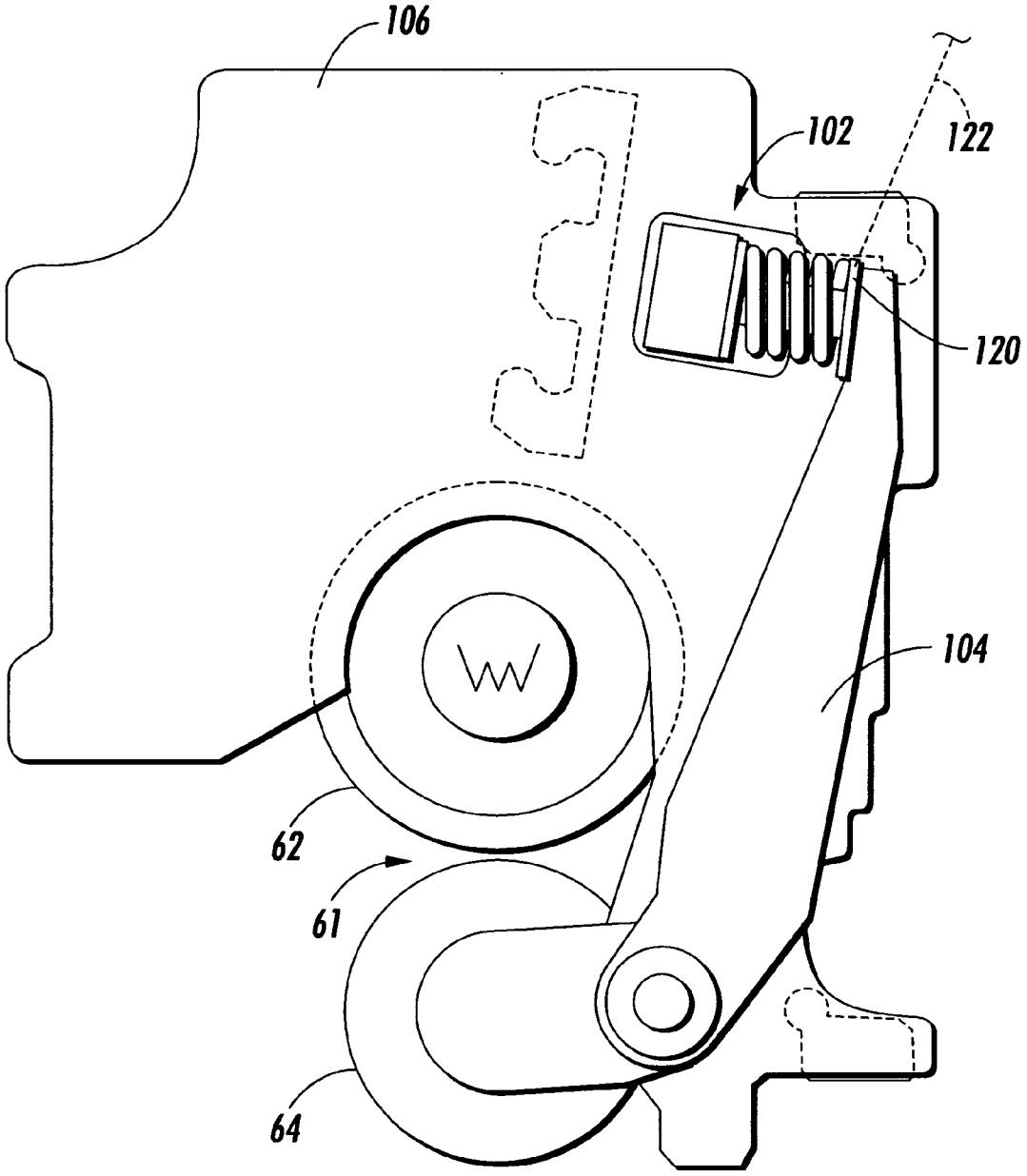
FIG. 3 is a schematic end view of the fusing apparatus of FIG. 1 showing a life-extending fusing nip force controlling assembly in accordance with the present invention.

Referring now to FIGS. 1 to 3 specifically, a roll fusing apparatus for effectively heating and fusing quality toner images on various different types of substrates is provided. The roll fusing apparatus includes a frame; a heated fuser roller having a first end and a second end respectively mounted to the frame; and a pressure roller mounted to the frame and forming a fusing nip with the heated fuser roller. The heated fuser roller and the pressure roller are movable for receiving, heating and applying a nip force to toner images being moved through the fusing nip on various different types of substrates. The roll fusing apparatus importantly includes a fusing nip force controlling assembly for precisely setting and controlling fusing nip forces within the fusing nip at different values for effectively heating and fusing quality toner images on the various different types of substrates. The fusing nip force controlling assembly includes a piezoelectric member connected to at least one of the heated fuser roller and the pressure roller for producing an electrical signal responsively and proportionally to a nip force being applied within the fusing nip between the heated fuser roller and the pressure roller.

The fusing apparatus 60 preferably includes one of the fusing nip force controlling assembly 100, mounted to the fuser frame, respectively near the first end and the second end of the heated fuser roller 62. As shown more clearly in FIG. 3, each of these fusing nip force controlling assemblies 100 includes an adjustable force applying means such as a compression spring and solenoid device 102, and an adjustment member such as a roller loading arm 104 for variably adjusting a force value of the adjustable force applying means or spring and solenoid device 102. Preferably as illustrated, the piezoelectric member or wafer 120 is mounted on the roller loading arm 104 (as shown clearly in FIG. 3) in series with the force applying means (spring and solenoid device 102) and the adjustment member (roller loading arm 104).

As discussed above, the electrostatographic reproduction machine 8—includes the microprocessor or ESS 90 which is connected to each of the piezoelectric members 120 for receiving and processing electrical signals 122 from each piezoelectric member 120, and for producing feedback 124 responsively to nip force adjustments. Preferably too, the electrostatographic reproduction machine 8 includes a display device 126 connected to the microprocessor for displaying in realtime feedback results of nip force adjustments.

To summarize, the fusing nip force controlling assembly 100 includes a fuser supporting frame 106 for the fuser and pressure rollers 62, 64, the force applying spring and solenoid device 102, an adjustable position roller loading arm 104, and the piezoelectric member 120 in the form of a wafer. As shown, the piezoelectric member 120 preferably is mounted in series with the force applying spring and solenoid device 102 so that the loaded force is transferred through it to the fuser and pressure roller loading arm 104. The piezoelectric member or force sensor 120 then sends an electrical signal 122 to the electronic subsystem (ESS) or machine 8 microprocessor 90 for processing and subsequent machine 8 control.

Where the fusing nip force controlling assembly 100 includes a driven automatic system (not shown) for changing the positions of the loading arm 104, then such a system will be operated by the ESS 90 to automatically adjust the first or inboard end loading arm, and the second or outboard loading arm, to desired positions for applying specific required forces to the fusing nip for quality toner image fusing.

In the case of a manual adjustment system, an off-specification value fusing nip force displayed on the device 126 will inform a technical operator or representative that a fusing nip force adjustment is required. Importantly, during such manual adjustments (for example using adjustment screws for changing the position of the roller loading arm) display of feedback force values 124 in realtime will greatly improve effectiveness by reducing the number of trial and error iterations from what would conventionally have been the case.

Further advantages of the present invention include improved control of copy quality, decreases in manufacturing fusing nip force setting time, fewer field service calls for out of specification conditions in nip forces and pressures, maximum life from the pressure and fuser rolls by detection and prevention of damaging nip forces and pressures. Importantly, a great advantage includes the ability to display and adjust easily and precisely different fusing nip force values for different types of toner image carrying substrates being used in the machine 8. Further more, because feedback 124 from the machine 8 ESS 90 is also in signal form, it can advantageously be inputted as nip force and pressure information into a Remote Interactive Control (RIC) system, for remote diagnostic and control, particularly where the roller loading arm can be moved by automatic means.

As can be seen, there has been provided a roll fusing apparatus for effectively heating and fusing quality toner images on various different types of substrates is provided. The roll fusing apparatus includes a frame; a heated fuser roller having a first end and a second respectively mounted to the frame; and a pressure roller mounted to the frame and forming a fusing nip with the heated fuser roller. The heated fuser roller and the pressure roller are movable for receiving, heating and applying a nip force to toner images being moved through the fusing nip on various different types of substrates. The roll fusing apparatus importantly includes a fusing nip force controlling assembly for precisely setting and controlling fusing nip forces within the fusing nip at different values for effectively heating and fusing quality toner images on the various different types of substrates. The fusing nip force controlling assembly includes a piezoelectric member connected to at least one of the heated fuser roller and the pressure roller for producing an electrical signal responsively and proportionally to a nip force being applied within the fusing nip between the heated fuser roller and the pressure roller.

While this invention has been described in conjunction with a particular embodiment thereof, it shall be evident that many alternatives, modifications and variations will be apparent to those skilled in the art. Accordingly, the present invention is intended to embrace all such alternatives, modifications and variations as fall within the spirit and broad scope of the appended claims.

What is claimed is:

1. A roll fusing apparatus for effectively heating and fusing quality toner images on various different types of substrates, the roll fusing apparatus comprising:

(a) a frame;

(b) a heated fuser roller having a first end and a second end respectively mounted to said frame;

(c) a pressure roller mounted to said frame and forming a fusing nip with said heated fuser roller, said heated fuser roller and said pressure roller being movable for receiving, heating and applying a nip force to toner images being moved through said fusing nip on various different types of substrates; and (d) a fusing nip force controlling assembly for precisely setting and controlling fusing nip forces within said fusing nip at different values for effectively heating and fusing quality toner images on the various different types of substrates, said fusing nip force controlling assembly including a roller loading arm for loading at least one of said heated fuser roller and said pressure roller against the other, and a piezoelectric member mounted to said roller loading arm for producing an electrical signal responsively and proportionally to a fusing nip force being applied by said roller loading arm.

2. The fusing apparatus of claim 1, including one said fusing nip force controlling assembly mounted to said fuser frame respectively near said first end and said second end of said heated fuser roller.

3. The fusing apparatus of claim 2, wherein each said fusing nip force controlling assembly includes an adjustable force applying means for variably adjusting a force value of said adjustable force applying means.

4. The fusing apparatus of claim 3, wherein in each said fusing nip force controlling assembly said piezoelectric member is mounted in series with said force applying means.

5. The fusing apparatus of claim 3, wherein said piezoelectric member comprises a piezoelectric wafer.

6. The fusing apparatus of claim 3, wherein said force applying means comprises a compression spring and solenoid device.

7. The electrostatographic reproduction machine of claim 6, including a microprocessor connected to said piezoelectric member for receiving and processing said electrical signal, and for producing feedback responsively to nip force adjustments.

8. The electrostatographic reproduction machine of claim 6, including a display device connected to said microprocessor for displaying in realtime feedback results of nip force adjustments.

9. An electrostatographic reproduction machine comprising:

(a) a movable image bearing member having an image bearing surface defining a path of movement therefor;

(b) electrostatographic devices mounted along said path of movement for forming and transferring toner images onto various different types of substrates; and (c) a roll fusing apparatus for effectively heating and fusing the toner images on various different types of substrates, the roll fusing apparatus including:

(i) a fuser frame;

(ii) a heated fuser roller having a first end and a second end respectively mounted to said fuser frame;

(iii) a pressure roller mounted to said fuser frame and forming a fusing nip with said heated fuser roller, said heated fuser roller and said pressure roller being movable for receiving, heating and applying a nip force to toner images being moved through said fusing nip on various different types of substrates; and (iv) a fusing nip force controlling assembly for precisely setting and controlling fusing nip forces within said fusing nip at different values for effectively heating and fusing quality toner images on the various different types of substrates, said fusing nip force controlling assembly including a roller loading arm for loading at least one of said heated fuser roller and said pressure roller against the other, and a piezoelectric member mounted to said roller loading arm for producing an electrical signal responsively and proportionally to a fusing nip force being applied by said roller loading arm.

* * * * *